US012723372B2

(12) United States Patent
Yuzawa

(10) Patent No.: US 12,723,372 B2
(45) Date of Patent: Sep. 1, 2026

(54) WORK MACHINE AND LOAD CALCULATION SYSTEM

(71) Applicant: SUMITOMO CONSTRUCTION MACHINERY CO., LTD., Tokyo (JP)

(72) Inventor: Yoshimitsu Yuzawa, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 197 days.

(21) Appl. No.: 18/475,648

(22) Filed: Sep. 27, 2023

(65) Prior Publication Data

US 2024/0026649 A1 Jan. 25, 2024

Related U.S. Application Data

(63) Continuation of application No. PCT/JP2022/016055, filed on Mar. 30, 2022.

(30) Foreign Application Priority Data

Mar. 31, 2021 (JP) ..... 2021-061460

(51) Int. Cl.
*E02F 9/22* (2006.01)

(52) U.S. Cl.
CPC ..... *E02F 9/2246* (2013.01)

(58) Field of Classification Search
CPC ..... E02F 9/2246; E02F 3/435; E02F 9/264; E02F 3/963; E02F 9/26; E02F 9/20; B66C 1/04; G01G 19/083; B60Y 2200/412
See application file for complete search history.

(56) References Cited

U.S. PATENT DOCUMENTS

| | | | | |
|---|---|---|---|---|
| 2009/0161284 | A1* | 6/2009 | Maraval | B66C 1/08 361/144 |
| 2014/0231153 | A1* | 8/2014 | Fukasu | E02F 9/2029 177/25.13 |
| 2017/0369286 | A1* | 12/2017 | Windbacher | B66C 23/66 |
| 2019/0156672 | A1* | 5/2019 | Konishi | G08G 1/20 |
| 2020/0087893 | A1 | 3/2020 | Hageman et al. | |
| 2020/0283993 | A1* | 9/2020 | Minagawa | E02F 9/205 |
| 2020/0340205 | A1* | 10/2020 | Naito | E02F 9/262 |
| 2021/0163267 | A1 | 6/2021 | Yuzawa et al. | |
| 2022/0364323 | A1* | 11/2022 | Gilbeck | B65G 67/04 |
| 2023/0358015 | A1* | 11/2023 | Miyazaki | E02F 3/435 |

FOREIGN PATENT DOCUMENTS

| | | |
|---|---|---|
| JP | 2014-001040 | 1/2014 |
| JP | 2017-227638 | 12/2017 |
| JP | 2018-145753 | 9/2018 |
| WO | 2004/005180 | 1/2004 |
| WO | 2020/022454 | 1/2020 |

OTHER PUBLICATIONS

International Search Report for PCT/JP2022/016055 mailed on Jun. 14, 2022.

* cited by examiner

*Primary Examiner* — Anne Marie Antonucci
*Assistant Examiner* — Luis G Del Valle
(74) *Attorney, Agent, or Firm* — IPUSA, PLLC

(57) ABSTRACT

A work machine having a load calculation function has a first mode and a second mode. The accuracy of the load calculation function in the first mode is different from the accuracy of the load calculation function in the second mode.

18 Claims, 6 Drawing Sheets

FIG.6

| | TARGET | LOADING TIME | ADJUSTING TIME | WORKING TIME |
|---|---|---|---|---|
| | t | MINUTES | MINUTES | MINUTES |
| COMPARATIVE EXAMPLE 1 | 23 | 24.6 | 9.2 | 33.8 |
| COMPARATIVE EXAMPLE 2 | 23 | 24.8 | 1.2 | 26.0 |
| EMBODIMENT | 23 | 20.3 | 3.5 | 23.8 |

WORK MACHINE AND LOAD CALCULATION SYSTEM

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2022/016055, filed on Mar. 30, 2022 and designating the U.S., which claims priority to Japanese Patent Application No. 2021-061460, filed on Mar. 31, 2021. The entire contents of the foregoing applications are incorporated herein by reference.

BACKGROUND

Technical Field

The present disclosure relates to work machines and load calculation systems.

Description of Related Art

So far, there have been known work machines that attract, lift, and load scrap iron and the like in carriers and the like of dump trucks, and matches the cumulative weight of the loaded scrap iron and the like with the target weight (the maximum loading weight of dump trucks).

SUMMARY

According to one aspect of the present disclosure, a work machine has a load calculation function. The work machine has a first mode and a second mode. The accuracy of the load calculation function in the first mode is different from the accuracy of the load calculation function in the second mode.

According to another aspect of the present disclosure, a load calculation system for a work machine is a load calculation system for a work machine, the load calculation system having a first mode and a second mode. The accuracy of a load calculation function in the first mode is different from the accuracy of a load calculation function in the second mode.

BRIEF DESCRIPTION OF THE DRAWINGS

FIG. 6 is an explanatory view of effects of the present embodiment.

DETAILED DESCRIPTION

In the existing techniques, when the work machines calculate the weight of the lifted objects, the posture and movement of the work machines need to meet preset requirements, and work efficiency may decrease.

Thus, it is desirable to increase work efficiency.

Figure 1:
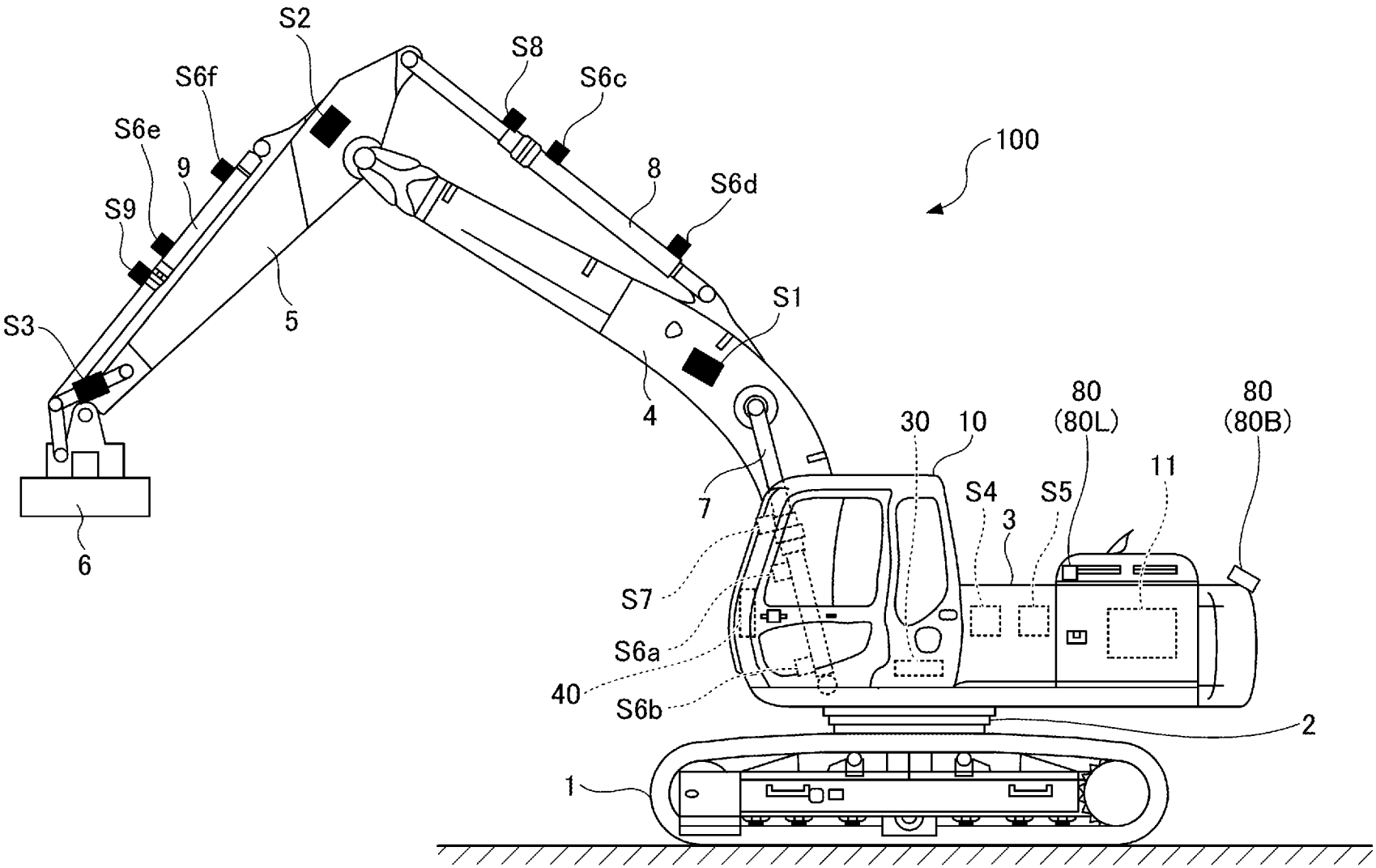
FIG. 1 is a side view of a work machine according to an embodiment of the present invention.

FIG. 1 is a side view of a work machine 100 according to an embodiment of the present invention. The work machine 100 includes a lower traveling body 1 and an upper swiveling body 3, which is mounted via a swiveling mechanism 2 to the lower traveling body 1. A boom 4 is attached to the upper swiveling body 3. An arm 5 is attached to the front end of the boom 4, and a lifting magnet 6 is attached as an end attachment to the front end of the arm 5. The boom 4 and the arm 5 form a working attachment that is one example of an attachment. The boom 4 is driven by a boom cylinder 7, the arm 5 is driven by an arm cylinder 8, and the lifting magnet 6 is driven by a lifting magnet cylinder 9.

A boom angle sensor S1 is attached to the boom 4, an arm angle sensor S2 is attached to the arm 5, and a lifting magnet angle sensor S3 is attached to the lifting magnet 6. A controller 30, a display device 40, a display device 50 (see FIG. 2), a photographing device 80, a machine body tilt sensor S4, and a swiveling angular velocity sensor S5 are attached to the upper swiveling body 3. Instead of or in addition to the photographing device 80, an object detection device may be attached to the upper swiveling body 3.

In the work machine 100 of the present embodiment, the controller 30 controls the lifting magnet 6 to be in an attractable state being capable of attracting an object (magnetic body) in response to an operation of a switch provided in an operation device 26 as described below. Conversely, in response to an operation of the switch provided in the operation device 26, the controller 30 controls the lifting magnet 6 in the attractable state to be in an unattractable state (releasable state). In the present embodiment, in this way, the lifting magnet 6 attracts an object and releases the object in a carrier of a delivery vehicle, whereby the object (e.g., scrap iron) is loaded to, for example, the carrier of the delivery vehicle. The delivery vehicle of the present embodiment includes dump trucks, trailers, and the like.

Here, a situation in which the work machine 100 of the present embodiment is utilized will be described. In the present embodiment, the work machine 100 performs loading of the object to the carrier of the delivery vehicle in a loading yard where the loading of the object is performed.

The delivery vehicle travels on, for example, a public road for delivering the objects loaded to the carrier to the destination. To do this, the weight of the loaded objects must not exceed the maximum loading weight of the delivery vehicle. Also, for efficiently delivering the objects, the objects are preferably loaded to the carrier of the delivery vehicle until the maximum loading weight of the delivery vehicle.

Under such circumstances, usually, once the loading of the objects to the carrier of the delivery vehicle has been completed, the delivery vehicle moves to an area where a truck scale is set, followed by weighing, thereby measuring the loading weight of the carrier.

When the loading weight has exceeded the maximum loading weight, the delivery vehicle returns to the loading yard, and the loaded objects are unloaded by the work machine 100, followed by weighing again. When the loading weight has lowered the maximum loading weight, the delivery vehicle returns to the loading yard, and is loaded with additional objects by the work machine 100, followed by weighing again.

Therefore, the closer to the maximum loading weight the loading weight of the objects loaded to the delivery vehicle in the loading yard, the fewer the number of times at which the delivery vehicle goes back and forth between the loading yard and the area where the truck scale is set, which is preferable.

Thus, the work machine 100 is required to load the objects in the loading yard so as to bring the loading weight of the carrier of the delivery vehicle closer to the maximum loading weight.

Especially when the delivery vehicle is a large-sized vehicle, the number of loading operations until the carrier of the delivery vehicle is fully loaded becomes greater, and rapid loading is required.

In view of this, the work machine 100 of the present embodiment is provided with a loading mode and an adjusting mode in the loading movement. In the loading mode, a weight calculation condition upon calculating the weight of a lifted object is not provided. In the adjusting mode, a weight calculation condition upon calculating the weight of a lifted object is provided. Here, the accuracy of a load calculation function in the adjusting mode is different from the accuracy of a load calculation function in the loading mode. In other words, the weight calculation condition of the adjusting mode is different from the weight calculation condition of the loading mode.

Specifically, in the loading mode, for example, the controller 30 may calculate the weight of an object attracted by the lifting magnet 6 at an appropriate timing determined based on, for example, a boom bottom pressure and a posture of the work machine 100.

Note that, in the loading mode of the present embodiment, the weight calculation condition is not provided; however, this is by no means a limitation. As long as the weight calculation condition of the loading mode is more lenient than the weight calculation condition of the adjusting mode, the weight calculation condition may be provided in the loading mode. The loading mode may be any given mode as long as the loading mode can achieve rapid loading compared to the adjusting mode.

Also, in the adjusting mode, for example, when the work machine 100 meets the weight calculation condition in relation to the speed and the movement, the work machine 100 calculates the weight of the object attracted by the lifting magnet 6 based on, for example, the boom bottom pressure and the posture of the work machine 100. The weight calculation condition in relation to the speed and the movement of the present embodiment is, for example, any one of the following or any combination thereof: the lifting magnet 6 passes through a region at a certain height; the angle of the lifting magnet 6 is an angle within a range that is regarded as being horizontal; a boom raising speed is within a predetermined range; an arm operation is not performed; and the movement of attachments is stopped.

In the loading mode, the weight calculation condition upon calculating the weight of the object is not provided. Thus, it is possible to rapidly calculate the weight of the object and load the object to the delivery vehicle. In the adjusting mode, the weight of the object is calculated with the weight calculation condition being provided. Thus, compared to the loading mode, it is possible to calculate the weight of the object with high accuracy. Here, the weight calculation condition that is lenient includes, for example, any one of the following or any combination thereof: the number of weight calculation conditions is small; the contents of the weight calculation condition are moderated; and the weight calculation condition is absent. The weight calculation condition that is moderated includes, for example: widening the range of the boom raising speed that is the weight calculation condition; and widening the range of the angle of the lifting magnet 6 that is regarded as being horizontal. Note that, in the present embodiment, when the weight calculation condition upon calculating the weight of the object is provided and a movement not to meet the weight calculation condition is instructed, an error screen may be displayed on the display device 40. Also, in the present embodiment, when the weight calculation condition upon calculating the weight of the object is provided and a movement that fails to meet the weight calculation condition is instructed, the movement of the attachments may be restricted so as to meet the weight calculation condition.

In the present embodiment, efficient loading can be achieved by combining these two modes together.

Specifically, the work machine 100 performs loading in the loading mode until the weight of the objects loaded to the carrier of the delivery vehicle becomes closer to the maximum loading weight of the delivery vehicle, and when the weight of the objects loaded to the carrier of the delivery vehicle is close to the maximum loading weight, the work machine 100 switches the loading mode to the adjusting mode to perform the loading.

In the present embodiment, in this way, by using the two modes, it is possible to achieve rapid loading while maintaining the accuracy of the weight of the objects loaded to the delivery vehicle, and to increase the work efficiency.

Note that, the loading movement of the present embodiment refers to a movement to attract the object with the lifting magnet 6 and calculate the weight of the attracted object, and then release the attracted object on the carrier of the delivery vehicle. Also, the number of loading operations of the present embodiment is how many times the lifting magnet 6 repeats attracting and releasing the object. That is, the number of loading operations is the number of the loading movements that are performed.

Also, in the following description, the function of calculating the weight of the object attracted by the lifting magnet 6 in the loading movement may be referred to as a load calculation function. Also, in the following description, the adjusting mode may be referred to as a first movement mode (first mode) and the loading mode may be referred to as a second movement mode (second mode). That is, the work machine 100 of the present embodiment has the load calculation function, and the accuracy of the load calculation function in the first movement mode is higher than the accuracy of the load calculation function in the second movement mode.

In the work machine 100 of the present embodiment, the boom angle sensor S1 is configured to detect a boom angle that is a rotation angle of the boom 4 with respect to the upper swiveling body 3. The boom angle sensor S1 may be, for example, a rotation angle sensor that detects a rotation angle of the boom 4 about a boom foot pin, a cylinder stroke sensor that detects the stroke length of a boom cylinder 7 (boom stroke length), or a tilt (acceleration) sensor that detects a tilt angle of the boom 4. The boom angle sensor S1 may also be a combination of an acceleration sensor and a gyro sensor. The same applies to: the arm angle sensor S2 that detects an arm angle that is a rotation angle of the arm 5 with respect to the boom 4; and the lifting magnet angle sensor S3 that detects a lifting magnet angle that is a rotation angle of the lifting magnet 6 with respect to the arm 5.

The machine body tilt sensor S4 is configured to detect the tilt of the upper swiveling body 3 (machine body tilt angle). In the present embodiment, the machine body tilt sensor S4 is an acceleration sensor that detects the tilt angles of the upper swiveling body 3 about the front-back axis and the left-right axis with respect to the horizontal surface. For example, the front-back axis and the left-right axis of the upper swiveling body 3 are orthogonal to each other and pass through the center point of the machine that is one point on the swiveling axis of the work machine 100.

The swiveling angular velocity sensor S5 is configured to detect the swiveling angular velocity of the upper swiveling body 3. In the present embodiment, the swiveling angular velocity sensor S5 is a gyro sensor. The swiveling angular velocity sensor S5 may be, for example, a resolver or a rotary encoder.

The photographing device 80 is configured to photograph the surroundings of the work machine 100. The photographing device 80 is, for example, a monocular camera, a stereo camera, a distance image camera, an infrared camera, or LIDAR. In the example of FIG. 1, the photographing device 80 includes: a back camera 80B attached at the back end of the upper surface of the upper swiveling body 3; a left-hand camera 80L attached at the left-hand end of the upper surface of the upper swiveling body 3; and a right-hand camera 80R (not visible in FIG. 1) attached at the right-hand end of the upper surface of the upper swiveling body 3.

The object detection device is configured to detect the objects existing around the work machine 100. The object detection device includes: a back sensor that monitors the backward space of the work machine 100; a left-hand sensor that monitors the leftward space of the work machine 100; and a right-hand sensor that monitors the rightward space of the work machine 100. The object detection device may include a front sensor that monitors the frontward space of the work machine 100. Each of the back sensor, the left-hand sensor, and the right-hand sensor is, for example, LIDAR, a millimeter-wave radar, or a stereo camera.

When an object is detected using an output of the photographing device 80, for example, the controller 30 subjects various image processes to an image taken by the photographing device 80, thereby detecting the object utilizing a publicly known image recognition technique. Note that, the photographing device 80 may include a front camera that photographs the forward space of the work machine 100. Note that, in the present embodiment, a surroundings-monitoring device that monitors the surroundings of the shovel 100 is included, and the surroundings-monitoring device includes the photographing device 80 and the object detection device.

The boom cylinder 7 may be provided with a pressure sensor S6*a*, a pressure sensor S6*b*, and a boom cylinder stroke sensor S7. The arm cylinder 8 may be provided with a pressure sensor S6*c*, a pressure sensor S6*d*, and an arm cylinder stroke sensor S8. The lifting magnet cylinder 9 may be provided with a pressure sensor S6*e*, a pressure sensor S6*f*, and a lifting magnet cylinder stroke sensor S9.

The pressure sensor S6*a* detects the pressure of a rod-side oil chamber of the boom cylinder 7, and the pressure sensor S6*b* detects the pressure of a bottom-side oil chamber of the boom cylinder 7 (hereinafter referred to as a "boom bottom pressure"). The pressure sensor S6*c* detects the pressure of a rod-side oil chamber of the arm cylinder 8, and the pressure sensor S6*d* detects the pressure of a bottom-side oil chamber of the arm cylinder 8. The pressure sensor S6*e* detects the pressure of a rod-side oil chamber of the lifting magnet cylinder 9, and the pressure sensor S6*f* detects the pressure of a bottom-side oil chamber of the lifting magnet cylinder 9.

The upper swiveling body 3 is provided with a cabin 10 serving as an operation room, and a power source such an engine 11 is mounted therein.

Figure 2:
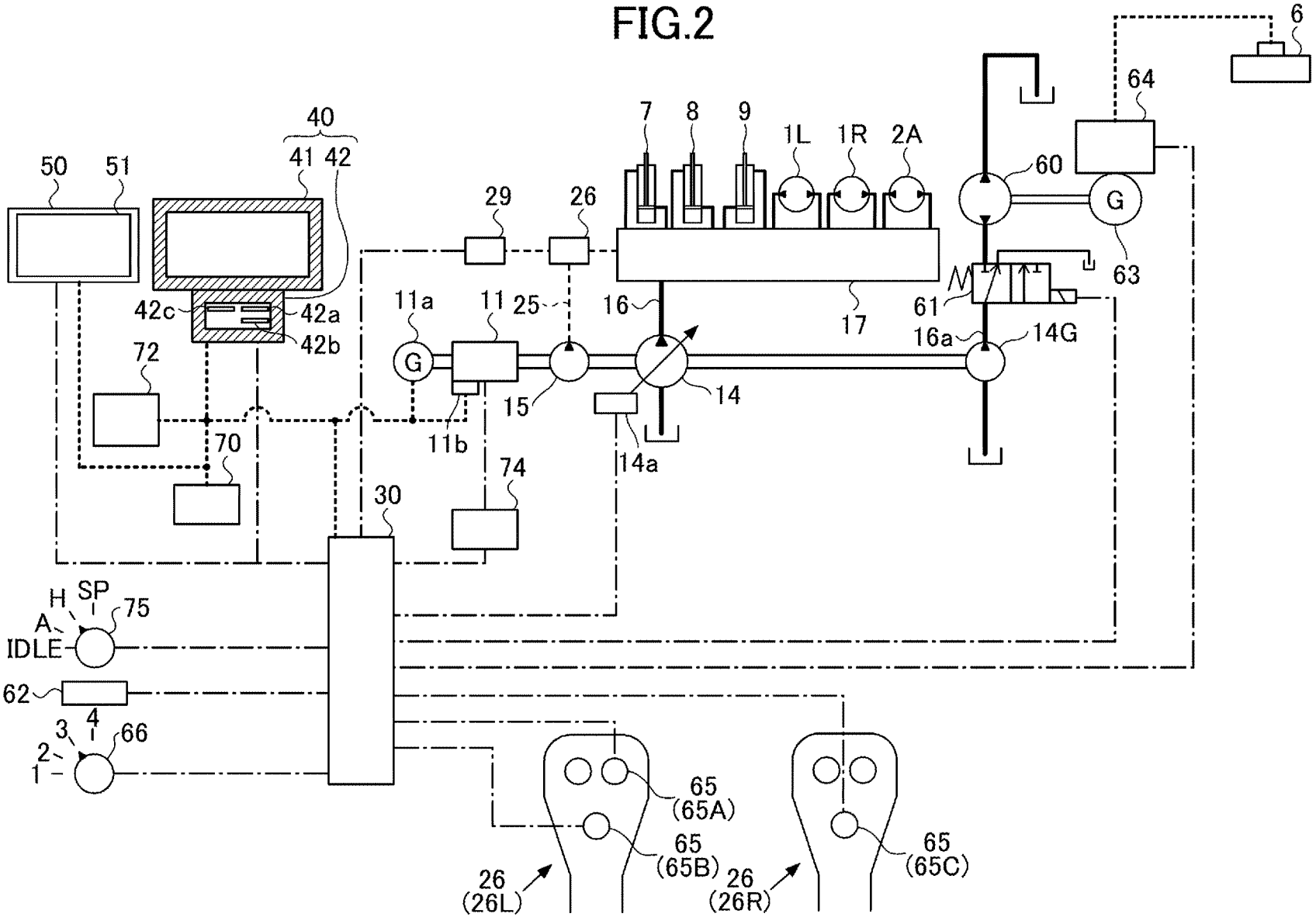
FIG. 2 is a block diagram illustrating a configurational example of a drive system provided in the work machine as illustrated in FIG. 1.

FIG. 2 is a diagram illustrating a configurational example of a drive system provided in the work machine 100. In FIG. 2, the mechanical power transmission line is denoted by a double line, the hydraulic oil line is by a thick solid line, the pilot line is by a dashed line, the electrical control line is by a chain line, and the electrical drive line is by a thick dotted line.

The drive system of the work machine 100 mainly includes an engine 11, a main pump 14, a hydraulic pump 14G, a pilot pump 15, a control valve unit 17, an operation device 26, a controller 30, and an engine control device 74.

The engine 11 is a power source of the work machine 100 and is, for example, a diesel engine that operates so as to maintain a predetermined number of rotations. An output shaft of the engine 11 is connected to respective input shafts of an alternator 11*a*, the main pump 14, the hydraulic pump 14G, and the pilot pump 15.

The main pump 14 feeds hydraulic oil to the control valve unit 17 via a hydraulic oil line 16. In the present embodiment, the main pump 14 is a swashplate-type variable displacement hydraulic pump.

A regulator 14*a* is configured to control the discharge amount of the main pump 14. In the present embodiment, the regulator 14*a* adjusts the tilt angle of the swashplate of the main pump 14 in accordance with, for example, a control signal from the controller 30, thereby controlling the discharge amount of the main pump 14.

The pilot pump 15 is configured to feed the hydraulic oil via a pilot line 25 to various hydraulic control devices including the operation device 26. In the present embodiment, the pilot pump 15 is a fixed displacement-type hydraulic pump. However, the pilot pump 15 may be omitted. In this case, the function of the pilot pump 15 may be realized by the main pump 14. That is, in addition to the function of feeding the hydraulic oil to the control valve unit 17, the main pump 14 may have the function of feeding the hydraulic oil to, for example, the operation device 26 after the pressure of the hydraulic oil is reduced with, for example, a restrictor.

The control valve unit 17 is a hydraulic control device that controls a hydraulic system in the work machine 100. For example, the control valve unit 17 selectively feeds the hydraulic oil discharged by the main pump 14 to one or more of the boom cylinder 7, the arm cylinder 8, the lifting magnet cylinder 9, a hydraulic motor 1L for traveling on the left-hand side, a hydraulic motor 1R for traveling on the right-hand side, and a hydraulic motor 2A for swiveling. Note that, in the following description, the boom cylinder 7, the arm cylinder 8, the lifting magnet cylinder 9, the hydraulic motor 1L for traveling on the left-hand side, the hydraulic motor 1R for traveling on the right-hand side, and the hydraulic motor 2A for swiveling are collectively referred to as a "hydraulic actuator".

The operation device 26 is a device used by an operator for operating the hydraulic actuator. In the present embodiment, the operation device 26 generates a pilot pressure by feeding the hydraulic oil from the pilot pump 15 to a pilot port of a corresponding flow rate control valve in the control valve unit 17. Specifically, the operation device 26 includes, for example: a left-hand operation lever for a swiveling operation and an arm operation; a right-hand operation lever for a boom operation and a lifting magnet operation; and a traveling pedal and a traveling lever (both of which are not illustrated). The pilot pressure changes in accordance with operation contents of the operation device 26 (e.g., an operation direction and an operation amount).

An operation pressure sensor 29 is configured to detect the pilot pressure generated by the operation device 26. In the present embodiment, the operation pressure sensor 29 detects the pilot pressure generated by the operation device 26, and outputs a detected value to the controller 30. The controller 30 identifies the operation contents of the operation device 26 based on an output of the operation pressure sensor 29.

The controller 30 is a control device that executes various arithmetic processing. In the present embodiment, the controller 30 is a microcomputer including, for example, a CPU, a volatile storage device, and a non-volatile storage device. For example, the controller 30 reads out programs corresponding to various functions from the non-volatile storage device and loads the programs in the volatile storage device, and causes the CPU to execute processes of those programs.

The hydraulic pump 14G is configured to feed the hydraulic oil to a hydraulic motor 60 via a hydraulic oil line 16*a*. In the present embodiment, the hydraulic pump 14G is a fixed displacement-type hydraulic pump, and feeds the hydraulic oil to the hydraulic motor 60 through a switching valve 61.

The switching valve 61 is configured to switch the flow of the hydraulic oil discharged by the hydraulic pump 14G. In the present embodiment, the switching valve 61 is an electromagnetic valve that changes in the valve position in accordance with a control command from the controller 30. The switching valve 61 has: a first valve position at which communication between the hydraulic pump 14G and the hydraulic motor 60 is permitted; and a second valve position at which communication between the hydraulic pump 14G and the hydraulic motor 60 is blocked.

In response to switching the operation mode of the work machine 100 to a lifting magnet mode through operation of a mode-changing switch 62, the controller 30 outputs a control signal to the switching valve 61 and switches the switching valve 61 to the first valve position. Also, in response to switching the operation mode of the work machine 100 to a mode other than the lifting magnet mode through operation of the mode-changing switch 62, the controller 30 outputs a control signal to the switching valve 61 and switches the switching valve 61 to the second valve position. FIG. 2 illustrates a state where the switching valve 61 is at the second valve position.

The mode-changing switch 62 is a switch that switches the operation mode of the work machine 100. In the present embodiment, the mode-changing switch 62 is a rocker switch disposed in the cabin 10. The operator operates the mode-changing switch 62 to switch between a shovel mode and the lifting magnet mode. The shovel mode is an operation mode in which the work machine 100 is operated as an excavator (shovel). For example, the shovel mode is selected when a bucket is attached to the front end of the arm 5 rather than the lifting magnet 6. The lifting magnet mode is a mode in which the work machine 100 is operated as a lifting magnet-equipped work machine. The lifting magnet mode is selected when the lifting magnet 6 is attached to the front end of the arm 5. Note that, the controller 30 may automatically switch the operation mode of the work machine 100 based on outputs of various sensors.

When the lifting magnet mode is selected, the switching valve 61 is set to the first valve position, and causes the hydraulic oil discharged by the hydraulic pump 14G to flow into the hydraulic motor 60. Meanwhile, when an operation mode other than the lifting magnet mode is selected, the switching valve 61 is set to the second valve position, and causes the hydraulic oil discharged by the hydraulic pump 14G to flow into a hydraulic oil tank without causing the hydraulic oil to flow into the hydraulic motor 60.

The rotation shaft of the hydraulic motor 60 is mechanically connected to the rotation shaft of an electric generator 63. The electric generator 63 is configured to generate an electric power for exciting the lifting magnet 6. In the present embodiment, the electric generator 63 is an alternating electric generator that operates in accordance with a control command from an electric power control device 64.

The electric power control device 64 is configured to control supply and block of the electric power for exciting the lifting magnet 6. In the present embodiment, the electric power control device 64 controls starting or stopping of generation of an alternating current by the electric generator 63 in accordance with an electric power start command or an electric power stop command from the controller 30. The electric power control device 64 is configured to convert the alternating current, which has been generated by the electric generator 63, to a direct current and supply the direct current to the lifting magnet 6. The electric power control device 64 can control the intensity of a voltage applied to the lifting magnet 6, and the intensity of a current flowing through the lifting magnet 6.

When a lifting magnet switch 65 is in an ON state in response to receiving an ON operation, the controller 30 outputs an attract command to the electric power control device 64. The electric power control device 64 that has received the attract command converts the alternating current, which has been generated by the electric generator 63, to the direct current, and supplies the direct current to the lifting magnet 6 and excites the lifting magnet 6. The excited lifting magnet 6 is in an attractable state being capable of attracting the object (magnetic body).

Also, when the lifting magnet switch 65 is in an OFF state in response to receiving an OFF operation, the controller 30 outputs a release command to the electric power control device 64. The electric power control device 64 that has received the release command stops the electric power generation by the electric generator 63, and turns the lifting magnet 6 in the attractable state into the unattractable state (releasable state). The releasable state of the lifting magnet 6 means a state of disappearance of an electromagnetic force generated by the lifting magnet 6 in response to the stop of supply of the electric power to the lifting magnet 6.

The lifting magnet switch 65 is a switch that switches between attraction and release by the lifting magnet 6. In the present embodiment, the lifting magnet switch 65 includes: a weak excitation button 65A and a strong excitation button 65B that are push-button switches provided at the top portion of a left-hand operation lever 26L; and a release button 65C that is a push-button switch provided at the top portion of a right-hand operation lever 26R.

The weak excitation button 65A is one example of an input device that applies a predetermined first voltage to the lifting magnet 6 and turns the lifting magnet 6 into the attractable state (weakly attractable state). The predetermined first voltage is, for example, a voltage that is set through a magnetic force adjusting dial 66.

The strong excitation button 65B is one example of an input device that applies a predetermined second voltage to the lifting magnet 6 and turns the lifting magnet 6 into the attractable state (strongly attractable state). The predetermined second voltage is a voltage higher than the predetermined first voltage. The predetermined second voltage is, for example, the maximum allowable voltage.

The release button 65C is one example of an input device that turns the lifting magnet 6 into the releasable state.

The magnetic force adjusting dial 66 is a dial that adjusts the magnetic force (attractive force) of the lifting magnet 6. In the present embodiment, the magnetic force adjusting dial 66 is disposed in the cabin 10, and is configured to switch the magnetic force (attractive force) of the lifting magnet 6 at four steps in response to pushing of the weak excitation button 65A. Specifically, the magnetic force adjusting dial 66 is configured to switch the magnetic force (attractive force) of the lifting magnet 6 at the four steps of from the first level to the fourth level. FIG. 2 illustrates a state where the third level is selected with the magnetic force adjusting dial 66.

The lifting magnet 6 is, for example, controlled so as to generate the magnetic force (attractive force) having a level that is set with the magnetic force adjusting dial 66. The magnetic force adjusting dial 66 outputs, to the controller 30, data indicating the level of the magnetic force (attractive force).

With this configuration, while moving the working attachments by operating the left-hand operation lever 26L with his/her left hand and the right-hand operation lever 26R with his/her right hand, the operator can use his/her fingers to cause the lifting magnet 6 to attract and release the object (magnetic body). Typically, the operator pushes the weak excitation button 65A with the lifting magnet 6 being brought into contact with the object (e.g., scrap iron), thereby attracting the scrap iron with the lifting magnet 6. Subsequently, the operator gradually increases the boom 4 and lifts the lifting magnet 6 that has attracted the scrap iron, and then pushes the strong excitation button 65B to increase the magnetic force (attractive force) of the lifting magnet 6. This is for preventing the scrap iron from dropping from the lifting magnet 6 during transportation of the scrap iron by an attachment operation (operation including the boom operation, the arm operation, the bucket operation, or any combination thereof) or by a swiveling operation.

Also, by adjusting the magnetic force (attractive force) of the lifting magnet 6 with the magnetic force adjusting dial 66, the operator can sort out the objects. For example, by using the magnetic force (attractive force) having a relatively weak level and selectively lifting and moving relatively light objects from a pile of scrap, the operator can sort out the relatively light objects from relatively heavy objects. When the operator uses the magnetic force (attractive force) having the relatively weak level, it is possible to prevent lifting of the relatively heavy objects.

In accordance with the presence or absence of or the intensity of the magnetic force (attractive force) of the lifting magnet 6, the work machine 100 may be configured so that the operation mode is automatically switched to a mode in which the movement thereof is limited. Specifically, the work machine 100 may be configured so that the operation mode is automatically switched to a speed-limited mode, in response to pushing of the weak excitation button 65A or the strong excitation button 65B. For example, the speed-limited mode is one example of the lifting magnet mode, and is an operation mode in which either or both of: the swiveling speed; and the driving speed of the attachment are limited.

Also, when a predetermined operation is performed or a predetermined state is achieved after pushing of the weak excitation button 65A, the work machine 100 may automatically shift the state of the lifting magnet 6 to the strongly attractable state, i.e., a state that is achieved in response to pushing of the strong excitation button 65B. The predetermined operation is, for example, the swiveling operation. The predetermined state is, for example, a state where the attachments have predetermined postures; e.g., a state where the boom angle is a predetermined angle. In this case, for example, even if the strong excitation button 65B is not pushed, the work machine 100 can automatically shift the weakly attractable state of the lifting magnet 6, which has been achieved in response to pushing of the weak excitation button 65A, to the strongly attractable state in response to lifting of the lifting magnet 6 in accordance with a boom raising operation, followed by a swiveling operation.

The display device 40 is a device that displays various information. In the present embodiment, the display device 40 is fixed to a pillar (not illustrated) at the right-front portion of the cabin 10 in which an operator's sheet is provided. Also, as illustrated in FIG. 2, the display device 40 can display information on the work machine 100 on an image display part 41, and provide the operator with the information. Also, the display device 40 includes an operation part 42 serving as an input device. The operator can input various commands to the controller 30 using the operation part 42.

The operation part 42 is a panel including various switches. In the present embodiment, the operation part 42 includes a light switch 42*a*, a wiper switch 42*b*, and a window washer switch 42*c* as hardware buttons. The light switch 42*a* is a switch for switching between ON and OFF of a light attached to the exterior of the cabin 10. The wiper switch 42*b* is a switch for switching between moving and stopping of a wiper. The window washer switch 42*c* is a switch for jetting a window washer liquid.

The display device 40 is configured to operate in response to supply of an electrical power from a storage battery 70. The storage battery 70 is configured to be charged with an electric power generated in the alternator 11*a*. The electric power of the storage battery 70 is supplied to, for example, electrical equipment 72 as well as the controller 30 and the display device 40. A starter 11*b* of the engine 11 is configured to be driven by the electric power from the storage battery 70 and start the engine 11.

The display device 50 (second display device) is a display device that is provided separately from the display device 40 (first display device) and displays a screen of loading when the work machine 100 is loading the objects (e.g., scrap iron) on the carrier of the delivery vehicle.

Similar to the display device 40, the display device 50 is fixed in the cabin 10 and driven by the electric power supplied from the storage battery 70. Also, the display device 50 includes an image display part 51. The image display part 51 of the present embodiment is, for example, a touch panel, and may perform both displaying of an image and receiving of an input of an operation. The display device 50 of the present embodiment displays a loading movement screen including information on the loading movement by the work machine 100. Details of the loading movement screen will be described below.

The engine control device 74 is configured to control the engine 11. In the present embodiment, the engine control device 74 collects various data indicating the state of the engine 11 and transmits the collected data to the controller 30. The engine control device 74 and the controller 30 are configured as separate members but may be configured as a single member. For example, the engine control device 74 may be integrated with the controller 30.

An engine rotation number adjusting dial 75 is a dial that adjusts the number of rotations of the engine. In the present embodiment, the engine rotation number adjusting dial 75 is disposed in the cabin 10, and is configured to switch the number of rotations of the engine at four steps. Specifically, the engine rotation number adjusting dial 75 is configured to switch the number of rotations of the engine at the four steps of an SP mode, an H mode, an A mode, and an idling mode. FIG. 2 illustrates a state where the H mode is selected with the engine rotation number adjusting dial 75.

The SP mode is a rotation number mode selected when one wishes to give priority to workload, and the highest number of rotations of the engine is used. The H mode is a rotation number mode selected when one wishes to achieve both the workload and efficient fuel consumption, and the second highest number of rotations of the engine is used. The A mode is a rotation number mode selected when one wishes to operate the work machine with low noise while giving priority to the efficient fuel consumption, and the third highest number of rotations of the engine is used. The idling mode is a rotation number mode selected when one wishes to operate the engine in an idling state, and the lowest number of rotations of the engine (number of rotations during idling) is used.

The engine 11 is controlled so that the number of rotations of the engine corresponding to the rotation number mode set with the engine rotation number adjusting dial 75 is maintained. The engine rotation number adjusting dial 75 outputs, to the controller 30, data indicating a setting state of the number of rotations of the engine.

Figure 3:
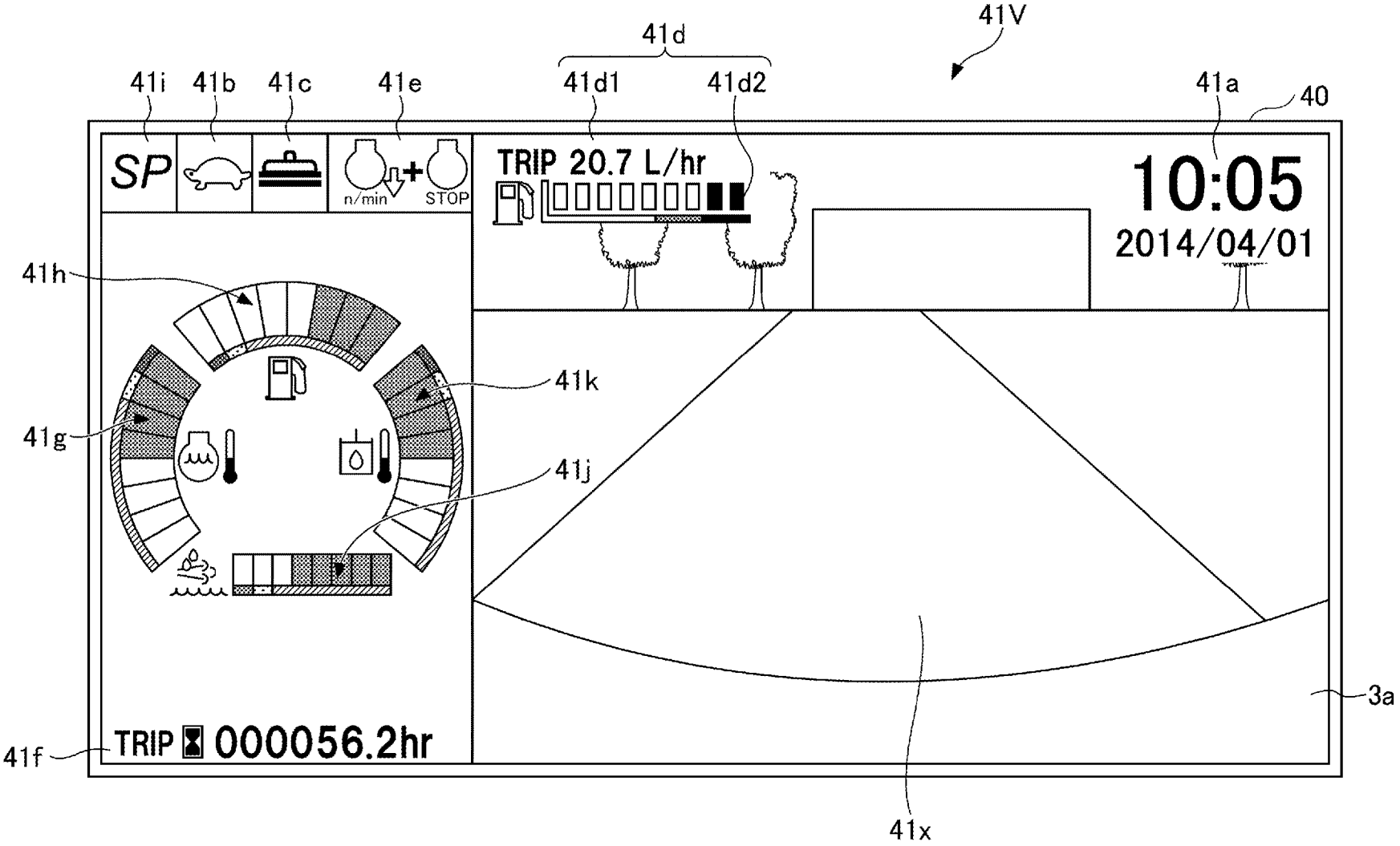
FIG. 3 is a view illustrating a configurational example of a main screen.

Next, referring to FIG. 3, a configurational example of a main screen 41V displayed on the display device 40 will be described. For example, the main screen 41V of FIG. 3 is displayed on the image display part 41 when the operation mode is the lifting magnet mode.

The main screen 41V includes a date and time display area 41*a*, a traveling mode display area 41*b*, an attachment display area 41*c*, a fuel consumption display area 41*d*, an engine control state display area 41*e*, an engine operating time display area 41*f*, a cooling water temperature display area 41*g*, a remaining fuel amount display area 41*h*, a rotation number mode display area 41*i*, a remaining urea water amount display area 41*j*, a hydraulic oil temperature display area 41*k*, and a camera image display area 41*x*.

The traveling mode display area 41*b*, the attachment display area 41*c*, the engine control state display area 41*e*, and the rotation number mode display area 41*i* are areas that display setting state information that is information in relation to the setting state of the work machine 100. The fuel consumption display area 41*d*, the engine operating time display area 41*f*, the cooling water temperature display area 41*g*, the remaining fuel amount display area 41*h*, the remaining urea water amount display area 41*j*, and the hydraulic oil temperature display area 41*k* are areas that display driving state information (operating state information) that is information in relation to a driving state (operating state) of the work machine 100.

Specifically, the date and time display area 41*a* is an area that displays the current date and time. The traveling mode display area 41*b* is an area that displays the current traveling mode. The attachment display area 41*c* is an area that displays an image showing the currently-attached end attachment. FIG. 3 illustrates a state where the image showing the lifting magnet 6 is displayed.

The fuel consumption display area 41*d* is an area displaying fuel consumption information calculated by the controller 30. The fuel consumption display area 41*d* includes: an average fuel consumption display area 41*dl* that displays a lifetime average fuel consumption or a section average fuel consumption; and an instantaneous fuel consumption display area 41*d*2 that displays instantaneous fuel consumption.

The engine control state display area 41*e* is an area that displays a control state of the engine 11. The engine operating time display area 41*f* is an area that displays a cumulative driving time of the engine 11. The cooling water temperature display area 41*g* is an area that displays a temperature state of the current engine cooling water. The remaining fuel amount display area 41*h* is an area that displays a state of the remaining amount of the fuel stored in a fuel tank. The rotation number mode display area 41*i* is an area that displays the current rotation number mode set with the engine rotation number adjusting dial 75. The remaining urea water amount display area 41*j* is an area that displays a state of the remaining amount of urea water stored in a urea water tank. The hydraulic oil temperature display area 41*k* is an area that displays a temperature state of the hydraulic oil in a hydraulic oil tank.

The camera image display area 41*x* is an area that displays an image taken by the photographing device 80. In the example of FIG. 3, the camera image display area 41*x* displays a back-camera image photographed by the back camera 80B. The back-camera image is a backward image reflecting the backward space of the work machine 100, and includes an image 3*a* of a counterweight.

Also, the controller 30 may be configured to add up the current weight after recognizing, based on the image taken by the photographing device 80, that the scrap iron lifted by the lifting magnet 6 has been loaded to the carrier of the delivery vehicle. This is for preventing the scrap iron transferred to places other than the carrier of the delivery vehicle from being added up as the scrap iron loaded to the delivery vehicle.

Based on the posture of the working attachment, the controller 30 may determine whether or not the scrap iron lifted by the lifting magnet 6 has been loaded to the carrier of the delivery vehicle. Specifically, for example, when the height of the lifting magnet 6 exceeds a predetermined value (e.g., the height of the carrier of the delivery vehicle) and the release button 65C is pushed, the controller 30 may determine that the scrap iron has been loaded to the carrier of the delivery vehicle.

The controller 30 may be configured to output a warning in response to determining that the current weight exceeds a predetermined value. The predetermined value is, for example, a value based on the rated lifting weight. The warning may be a visual warning, an auditory warning, or a tactile warning. With this configuration, the controller 30 can notify the operator of the fact, or a risk thereof, that the current weight exceeds the predetermined value.

When relatively small scraps such as scrap iron are to be lifted, the work machine 100 does not excessively increase the current weight because of limitation on the volume of scraps attracted by the lifting magnet 6. However, when relatively large objects such as iron plates or iron masses are to be lifted, the work machine 100 may lift such excessively heavy objects that a stability value SV of the work machine 100 becomes less than a predetermined value (e.g., 1.0). Note that, the stability value SV of the work machine 100 is expressed as $SV=(W2\times L2)/(W1\times L1)$. Here, W1 denotes the weight of a working attachment (including the weight of the lifted objects) and L1 denotes the horizontal distance from the tipping point to the center of gravity of the working attachment. Also, W2 denotes the weight of a machine body of the work machine 100 (excluding the weight of the working attachment) and L2 denotes the horizontal distance from the tipping point to the center of gravity of the machine body.

When the excessively heavy object has been lifted, the controller 30 can sound a buzzer and display, on the display device 40, an image showing that the current weight exceeds the predetermined value. Therefore, the controller 30 can prevent continuation of a state where the excessively heavy object is being lifted, while the operator is not noticing such a state. As a result, the controller 30 can enhance safety in the operation of the work machine 100.

Figure 4:
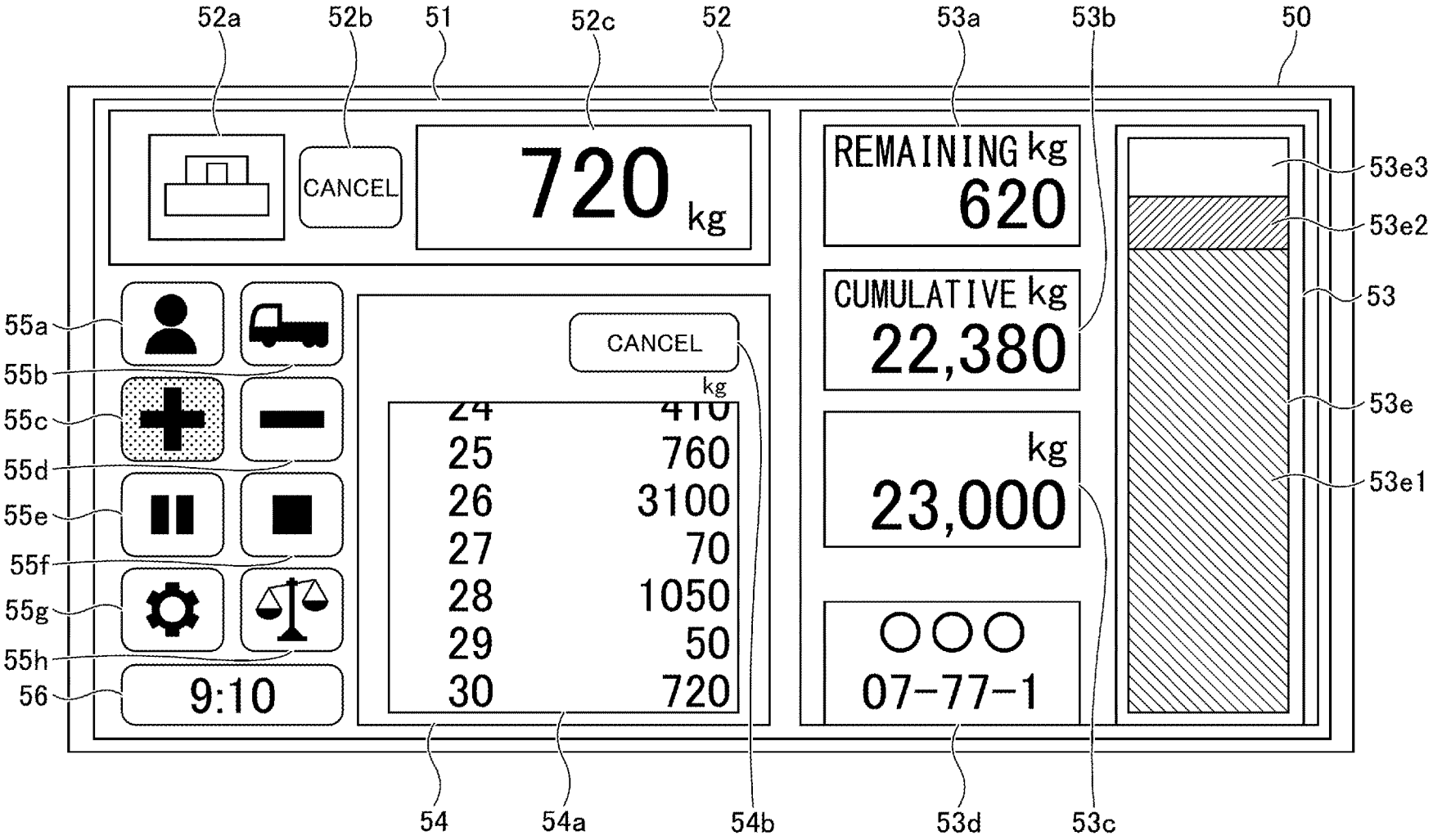
FIG. 4 is a first view illustrating one example of a loading movement screen.

Next, referring to FIG. 4 and FIG. 5, the loading movement screen displayed on the image display part 51 of the display device 50 will be described. FIG. 4 is a first view illustrating one example of the loading movement screen.

The loading movement screen displayed on the image display part 51 as illustrated in FIG. 4 includes display areas 52, 53, and 54. Also, the loading movement screen displayed on the image display part 51 includes operation buttons 55*a* to 55*h*.

The display area 52 includes a display section 52*a*, an operation button 52*b*, and a display section 52*c*. The display section 52*a* displays an icon image illustrating the kind of an end attachment attached to the work machine 100. In the example of FIG. 4, the display section 52*a* displays an icon image illustrating the lifting magnet 6. Note that, the end attachment attached to the work machine 100 is not limited to the lifting magnet 6, but may be, for example, a bucket or a grapple.

The operation button 52*b* is an operation button that when the object attracted by the lifting magnet 6 is released, avoids adding the calculated weight to the cumulative weight of the objects loaded to the delivery vehicle. This operation button 52*b* is operated, for example, when the lifting magnet 6 has attracted an object that is not to be loaded to the delivery vehicle.

The display section 52*c* is an area that displays the weight of the object that is currently being lifted by the lifting magnet 6 (hereinafter referred to as a "current weight"). FIG. 4 illustrates that the current weight is 720 kg.

The controller 30 calculates the current weight based on, for example: the posture of the working attachment; the boom bottom pressure; and the previously-registered specifications of the working attachment (e.g., the weight and the position of the center of gravity). Specifically, the controller 30 calculates the current weight based on outputs of information obtaining devices such as the boom angle sensor S1, the arm angle sensor S2, the lifting magnet angle sensor S3, and the pressure sensor S6*b*.

The display area 53 includes display sections 53*a*, 53*b*, 53*c*, 53*d*, and 53*e*. The display section 53*a* displays the difference between the weight of the objects loaded to the delivery vehicle, and the maximum loading weight. In other words, the display section 53*a* displays the difference between the weight of the objects loaded by the work machine 100 to the delivery vehicle, and the maximum loading weight of the delivery vehicle.

The display section 53*b* is an area that displays a cumulative value of the weights of the objects that have been lifted by the lifting magnet 6 for a predetermined period (hereinafter referred to as a "cumulative weight"). FIG. 4 illustrates that the cumulative weight is 22380 kg. The weight of the objects lifted by the lifting magnet 6 is, for example, added up every time the release button 65C is pushed.

The predetermined period is, for example, a period that starts upon pushing of the below-described operation button 55*f* (reset button). For example, when performing an operation to load the scrap iron to the carrier of the delivery vehicle, the operator of the work machine 100 resets the cumulative weight by pushing the operation button 55*f* every time the delivery vehicle for loading changes. This is because it becomes possible to readily identify the total weight of the scrap iron loaded to each of the delivery vehicles.

With this configuration, the work machine 100 can suppress or prevent the scrap iron from being loaded to the carrier of the delivery vehicle in excess of the maximum loading weight of the delivery vehicle. Also, the work machine 100 can suppress or prevent the weight of the scrap iron loaded to the carrier of the delivery vehicle from becoming much lower than the maximum loading weight of the delivery vehicle.

Once loading of the scrap iron in excess of the maximum loading weight has been detected through weight measurement with the truck scale, a driver of the delivery vehicle needs to return the delivery vehicle to the loading yard, and unload a part of the scrap iron loaded to the carrier. Meanwhile, once the weight of the scrap iron loaded to the carrier has been detected to be much lower than the maximum loading weight of the delivery vehicle through weight measurement with the truck scale, a driver of the delivery vehicle needs to return the delivery vehicle to the loading yard, and load additional scrap iron. The work machine 100 can prevent such an adjustment operation of the loading weight from occurring over and over again. For example, the work machine 100 needs such an adjustment operation of the loading weight only once.

The predetermined period may be, for example, a period of from the time of starting the operation for a day to the time of ending the operation for that day. This is because it becomes possible for the operator or manager to readily recognize the total weight of the scrap iron delivered by the operation for the day.

The display section 53*c* displays the maximum loading weight of the delivery vehicle. The display section 53*d* displays vehicle identification information (vehicle number) of the delivery vehicle and the name of the driver of the delivery vehicle.

Note that, the maximum loading weight of the delivery vehicle and the vehicle number may be previously registered upon selecting the delivery vehicle by operating the below-described operation button 55*b*. Also, the driver of the delivery vehicle may be registered by operating the below-described operation button 55*a*. Also, the display section 53*d* may display the name of the operator of the work machine 100.

The display section 53*e* displays a bar graph indicating a proportion of the weight of the loaded objects (loading weight) with respect to the maximum loading weight of the delivery vehicle. In the example of FIG. 4, the color of the bar graph for display changes when the loading weight becomes equal to or higher than a certain proportion in the bar graph displayed on the display section 53*e*.

For example, when the loading weight is less than 80% of the maximum loading weight, a corresponding area of the bar graph may be displayed in green, and when the loading weight is equal to or more than 80% of the maximum loading weight, a corresponding area of the bar graph may be displayed in yellow. When the loading weight exceeds the maximum loading weight, a corresponding area to the exceeded part in the bar graph may be displayed in red. Alternatively, when the loading weight exceeds the maximum loading weight, a notification may be made with sound, light, or the like.

In the example of FIG. 4, an area 53*e*1 may be displayed in green and an area 53*e*2 may be displayed in yellow in the bar graph displayed on the display section 53*e*. Also, in the example of FIG. 4, when the loading weight exceeds the maximum loading weight, a region 53*e*3 may be displayed in red.

In the present embodiment, in this way, by displaying in different colors the proportions of the loading weight with respect to the maximum loading weight of the delivery vehicle, it is possible to visually notify the operator of the work machine 100 of how much of the carrier is vacant.

The display area 54 includes a display section 54*a* and an operation button 54*b*. The display section 54*a* displays the history of the loading movements. For example, as is found from the display section 54*a* of FIG. 4, an object of 760 kg is loaded to the delivery vehicle in the $25^{th}$ loading movement, and an object of 3100 kg is loaded to the delivery vehicle in the $26^{th}$ loading movement. Also, as is found from the display section 54*a* of FIG. 4, an object of 70 kg is loaded to the delivery vehicle in the $27^{th}$ loading movement.

In other words, as is found from the display section 54*a*, for example, the object of 760 kg is attracted and lifted by the lifting magnet 6 and then released in the $25^{th}$ loading movement, and the object of 1050 kg is attracted and lifted by the lifting magnet 6 and then released in the $28^{th}$ loading movement. Also, as is found from the display section 54*a* of FIG. 4, the object of 1050 kg is attracted and lifted by the lifting magnet 6 and then released in the $28^{th}$ loading movement.

The operation button 54*b* is an operation button for deleting the history of a selected loading movement from the history displayed on the display section 54*a*.

For example, when the $27^{th}$ loading movement is selected and then the operation button 54*b* is selected in the display section 54*a*, 70 kg added up to the loading weight as the weight of the object loaded to the delivery vehicle in the $27^{th}$ loading movement is subtracted from the cumulative weight displayed on the display section 53*b*.

There may be a case of attracting, lifting, and releasing an unintended object for loading in a distant place to remove this unintended object during the loading movement of the objects to the delivery vehicle.

In the present embodiment, in the history of the loading movements displayed on the display section 54*a*, the weights of the objects lifted in the $27^{th}$ loading movement and the $29^{th}$ loading movement are much lighter than those in the other loading movements. Such loading movements are movements for removing the unintended objects. Therefore, by selecting the $27^{th}$ and the $29^{th}$ loading movements and the histories thereof and then selecting the operation button 54*b*, the operator of the work machine 100 can subtract, from the cumulative weight, the weights of the objects lifted in the $27^{th}$ and the $29^{th}$ loading movements.

The operation button 55*a* is an operation button for changing to a registration screen for registering on the operator of the work machine 100. The registration screen of the operator of the work machine 100 may be, for example, a screen that receives an input of the name of the operator of the work machine 100 or a screen that displays the list of the names of the operators previously registered.

The operation button 55*b* is an operation button for changing the loading movement screen displayed on the image display part 51 to a registration screen for registering the vehicle number of the delivery vehicle displayed on the display section 53*d*. The registration screen of the vehicle number of the delivery vehicle may be, for example, a screen that receives an input of the vehicle number of the delivery vehicle or a screen that displays the list of the names of the vehicle numbers of the delivery vehicles previously registered.

The operation button 55*c* is an operation button for causing the work machine 100 to perform the loading movement. When the lifting magnet 6 lifts an object after operation of the operation button 55*c*, the controller 30 of the present embodiment adds the weight of the lifted object to the loading weight displayed on the display section 53*b*.

The operation button 55*d* is an operation button for causing the work machine 100 to perform an unloading movement. When the lifting magnet 6 lifts an object after operation of the operation button 55*d*, the controller 30 of the present embodiment subtracts the weight of the lifted object from the loading weight displayed on the display section 53*b*.

The operation button 55*e* is an operation button for suspending addition of the weight of the object lifted by the lifting magnet 6 to the cumulative weight displayed on the display section 53*b*. In the present embodiment, when the operation button 55*e* is operated, even if the lifting magnet 6 lifts an object, the controller 30 does not add the weight of the object to the cumulative weight.

Note that, in the present embodiment, when the operation button 55*e* is selected again, the controller 30 may release the suspension of addition to the cumulative weight.

The operation button 55*f* is an operation button that is operated when the loading movement to the delivery vehicle has been completed. When the operation button 55*f* is operated, the cumulative weight displayed on the display section 53*b* is reset. The operation button 55*f* may be a hardware button disposed in, for example, the operation part 42, the left-hand operation lever 26L, or the right-hand operation lever 26R.

Also, the controller 30 may be configured to automatically reset the cumulative weight by automatically recognizing changing of the delivery vehicle. In this case, the controller 30 may use an image taken by the photographing device 80 for recognizing the changing of the delivery vehicle, or may use a communication device for recognizing the changing of the delivery vehicle.

Also, the operation of the operation button 55*f* is regarded as completion of the loading movement to the delivery vehicle identified by the vehicle number displayed on the display section 53*d*, and the controller 30 may change the loading movement screen to a selection screen of the delivery vehicle. When a delivery vehicle has been selected, the controller 30 may display a loading movement screen for a newly selected delivery vehicle, the loading movement screen including the display section 53*d* that displays the vehicle number of the newly selected delivery vehicle.

The operation button 55*g* is an operation button for changing the loading movement screen displayed on the image display part 51 to a setting screen for performing various settings in relation to the loading movement. When the operation button 55*g* has been operated, the controller 30 changes the loading movement screen to the setting screen.

Specifically, for example, in the present embodiment, when the delivery vehicle moves from the loading yard to the area where the truck scale is set, followed by weighing, the operator of the work machine 100 receives, from a person in charge of weighing, a notification of the cumulative weight that is a weighing result.

In the present embodiment, when the notified cumulative weight is not identical to the cumulative weight displayed on the display section 53*b*, the operator of the work machine 100 can rewrite, on the setting screen, the cumulative weight displayed on the display section 53*b* with the cumulative weight (actual load) that is the weighing result.

In the present embodiment, in this way, the cumulative weight calculated in the work machine 100 can be rewritten with the actually weighed cumulative weight, and thus when the delivery vehicle returns to the loading yard again after the weighing, it is possible to perform loading or unloading using the actual cumulative weight as a reference.

The operation button 55*h* is an operation button for switching between the loading mode and the adjusting mode in the loading movement. In the present embodiment, when the operation button 55*h* has not been selected, the loading movement is performed in the loading mode. Also, in the present embodiment, when the operation button 55*h* is operated, the loading mode is switched to the adjusting mode.

Note that, in the present embodiment, the loading mode and the adjusting mode are switched by the operation button 55*h* displayed on the loading movement screen; however, this is by no means a limitation. The switch between the loading mode and the adjusting mode may be performed based on, for example, an operation of the switch provided in the operation device 26.

The display section 56 displays the current time.

In this way, in the loading movement screen of the present embodiment, it is possible to switch between the loading movement mode and the adjusting mode.

Figure 5:
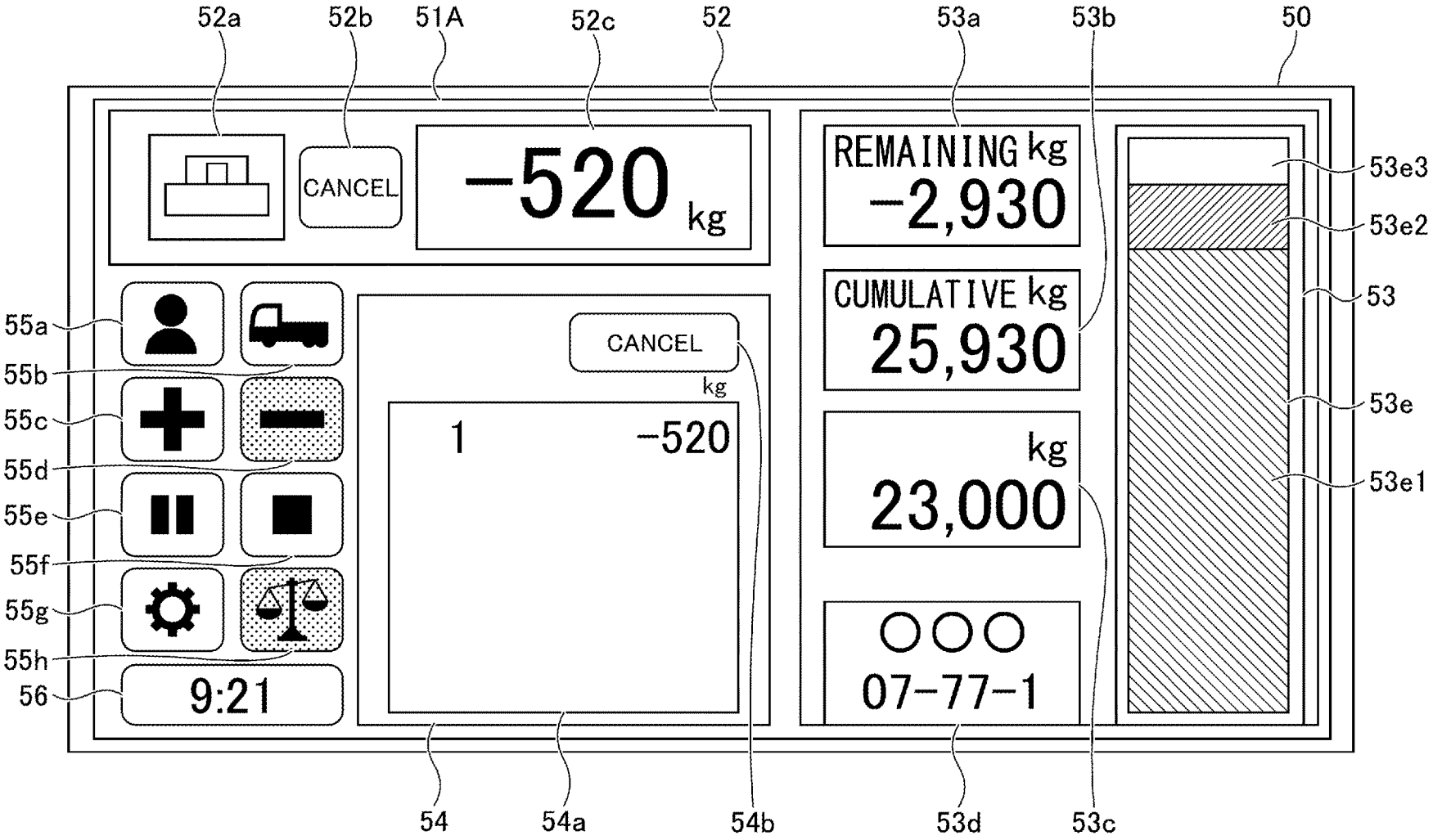
FIG. 5 is a second view illustrating one example of the loading movement screen.

FIG. 5 is a second view illustrating one example of the loading movement screen. The loading movement screen as illustrated in FIG. 5 illustrates one example of the loading movement screen for a case in which the delivery vehicle finishes undergoing weighing, returns to the loading yard again, and performs unloading.

As illustrated, the operation button 55*d* is selected, and the movement of the work machine 100 is unloading. Also, in the example of FIG. 5, the operation button 55*h* is selected, and the loading movement is performed in the adjusting mode.

Also, the display section 52*c* displays "−520 kg" as the current weight, and the current weight is subtracted from the cumulative weight.

Also, in FIG. 5, the cumulative weight displayed on the display section 53*b* exceeds the maximum loading weight displayed on the display section 53*c*. Therefore, the display section 53*a* displays −2930 kg that is the weight to be reduced through unloading to bring the cumulative weight closer to the maximum loading weight.

In this way, in the present embodiment, for example, the loading movement may be performed in the loading mode before weighing, and after the weighing, the cumulative weight may be adjusted to become closer to the maximum loading weight in the adjusting mode.

As described above, in the present embodiment, by providing the loading movement with the adjusting mode having the weight calculation condition and the loading mode having the weight calculation condition that is more lenient than the adjusting mode and by combining these modes together, it is possible to rapidly load the object to the delivery vehicle.

Note that, FIG. 4 and FIG. 5 illustrate that the loading movement screen is displayed on the image display part 51 of the display device 50; however, this is by no means a limitation. For example, when the number of display devices provided in the work machine 100 is one, this display device may display not only the loading movement screen but also the backward image of the work machine 100 as illustrated in FIG. 3, an overhead image of the surroundings of the work machine 100, and the like.

In the following, referring to FIG. 6, the effects of the present embodiment will be described. FIG. 6 is an explanatory view of the effects of the present embodiment.

FIG. 6 gives comparisons of a loading time, an adjusting time, and a working time between Comparative Examples 1 and 2 and a case in which the present embodiment is applied, with the target loading weight being 23 t.

Comparative Example 1 is a case in which the weight of an object lifted by the lifting magnet 6 is not calculated upon loading the object from the work machine 100 to the delivery vehicle, and the object is loaded by, for example, visual estimation of the operator of the work machine 100, followed by weighing. Comparative Example 2 is a case in which the weight of an object lifted by the lifting magnet 6 is calculated in the adjusting mode upon loading the object to the delivery vehicle, followed by weighing.

From the example of FIG. 6, in Comparative Example 1, 24.6 minutes is taken as the loading time of from the start of loading the objects to the delivery vehicle to the time the objects loaded to the delivery vehicle achieve the maximum loading weight. Also, in Comparative Example 1, 9.2 minutes is taken as the adjusting time for bringing the cumulative weight of the delivery vehicle closer to the maximum loading weight after the weighing. Therefore, the working time in Comparative Example 1 is 33.8 minutes, i.e., the sum of 24.6 minutes and 9.2 minutes.

In Comparative Example 2, the loading time is 24.8 minutes and the adjusting time is 1.2 minutes, and thus the working time in Comparative Example 2 is 26.0 minutes.

Meanwhile, in the case in which the present embodiment is applied, the loading time is 20.3 minutes, the adjusting time is 3.5 minutes, and the working time is 23.8 minutes.

In this way, it is found in the present embodiment that the working time is shortened and work efficiency is improved.

Therefore, in the present embodiment, for example, even if the delivery vehicle is a large-sized vehicle of 20 t or heavier, and the number of loading operations until the carrier thereof is fully loaded becomes greater than in standard delivery vehicles, it is possible to perform a rapid loading operation.

The present embodiment has been described above with reference to specific examples. However, the present invention is not limited to these specific examples. Those that are achieved by persons skilled in the art by appropriately adding design changes to these specific examples are included in the scope of the present invention as long as they have the features of the present invention. The components and arrangements thereof, conditions, shapes, and the like included in the above-described specific examples are not necessarily limited to exemplified ones and can be appropriately modified. The components included in the above-described specific examples may be appropriately combined together unless there is any technical contradiction.

For example, in the above-described embodiments, the loading mode may be automatically switched to the adjusting mode by recognizing that the state before weighing has been changed to the state after weighing. Note that, whether the current work is before weighing or after weighing may be determined based on an output of the surroundings-monitoring device. Also, whether the current work is before weighing or after weighing may be determined based on predetermined information in relation to weighing received by the shovel 100. The predetermined information in relation to weighing is, for example, a notification that weighing has been performed and the delivery vehicle returns to the loading yard. Also, for example, in the above-described embodiments, the loading mode may be automatically switched to the adjusting mode when the loading weight becomes closer to the maximum loading weight in the case of performing the loading operation to the carrier of the delivery vehicle.

It should be understood that the invention is not limited to the above-described embodiment, but may be modified into various forms on the basis of the spirit of the invention. Additionally, the modifications are included in the scope of the invention.

What is claimed is:

1. A work machine having a load calculation function, the work machine comprising:

a controller, wherein the controller realizes a first mode and a second mode in the load calculation function, the controller is configured to switch between the first mode and the second mode by changing a weight calculation condition in a calculation executed by the controller, and accuracy of the load calculation function in the first mode is different from accuracy of the load calculation function in the second mode, wherein, in the first mode, when the work machine satisfies at least one predetermined operational condition, a weight of a load attracted by a lifting magnet is calculated, wherein the predetermined operational condition includes at least one of: a condition relating to a position of the lifting magnet, a condition relating to a posture of the lifting magnet, a condition relating to a movement speed of a component of the work machine, or a condition relating to a non-operating state of the component of the work machine, and wherein the predetermined operational condition required for the first mode includes a condition that the lifting magnet passes through a region at a predetermined height to separate from surrounding objects, and wherein a weight calculation condition in the second mode is more lenient than a weight calculation condition in the first mode by at least relaxing the condition that the lifting magnet passes through a region at a predetermined height.

2. The work machine according to claim 1, wherein a weight calculation condition provided to the work machine in the second mode is different from a weight calculation condition provided to the work machine in the first mode.

3. The work machine according to claim 1, further comprising a display device, wherein the display device displays a screen in relation to the load calculation function, and a value of an actual load is input through an operation of the screen.

4. The work machine according to claim 3, wherein the value of the actual load is a value obtained by measuring a delivery vehicle to which an object is loaded by the work machine.

5. The work machine according to claim 3, wherein the first mode and the second mode are switched through the operation of the screen or an operation of a switch provided in an operation room.

6. The work machine according to claim 3, wherein the load calculation function is a function of calculating a weight of a lifted object in a loading movement that loads, to a delivery vehicle, an object lifted by an end attachment of the work machine, and the loading movement has the first mode and the second mode.

7. The work machine according to claim 6, wherein through the operation of the screen, identification information identifying the delivery vehicle, and an operation to register a driver of the delivery vehicle and an operator of the work machine are received.

8. The work machine according to claim 1, further comprising a surroundings-monitoring device, wherein the work machine determines whether or not an object lifted by the work machine is loaded to a carrier of a delivery vehicle based on a detection result of the surroundings-monitoring device.

9. The work machine according to claim 1, wherein the work machine includes a display device that displays a weight of an object loaded by the work machine.

10. The work machine according to claim 9, wherein the display device simultaneously displays: the weight of the object loaded by the work machine; and setting state information or operating state information.

11. The work machine according to claim 9, wherein the display device includes a first display device and a second display device, and the first display device displays setting state information or operating state information, and the second display device displays the weight of the object loaded by the work machine.

12. The work machine according to claim 9, wherein the display device simultaneously displays: the weight of the object loaded by the work machine; and a photographed image.

13. The work machine according to claim 9, wherein the display device includes a first display device and a second display device, and the first display device displays a photographed image, and the second display device displays the weight of the object loaded by the work machine.

14. A load calculation system, comprising:

a work machine having a load calculation function, the work machine including a controller, wherein the controller realizes a first mode and a second mode in the load calculation function, the controller is configured to switch between the first mode and the second mode by changing a weight calculation condition in a calculation executed by the controller, and accuracy of a load calculation function in the first mode is different from accuracy of a load calculation function in the second mode, wherein, in the first mode, when the work machine satisfies at least one predetermined operational condition, a weight of a load attracted by a lifting magnet is calculated, wherein the predetermined operational condition includes at least one of: a condition relating to a position of the lifting magnet, a condition relating to a posture of the lifting magnet, a condition relating to a movement speed of a component of the work machine, or a condition relating to a non-operating state of the component of the work machine, and wherein the predetermined operational condition required for the first mode includes a condition that the lifting magnet passes through a region at a predetermined height to separate from surrounding objects, and wherein a weight calculation condition in the second mode is more lenient than a weight calculation condition in the first mode by at least relaxing the condition that the lifting magnet passes through a region at a predetermined height.

15. The work machine according to claim 1, wherein the lifting magnet is mounted to a distal end of a boom of the work machine and configured to attract the load by magnetic force, and the weight of the load is calculated while the load is being attracted by the lifting magnet.

16. The work machine according to claim 1, wherein the controller is configured to calculate a cumulative weight of objects loaded to a delivery vehicle, and wherein the controller is configured to operate in the second mode until the cumulative weight approaches a maximum loading weight of the delivery vehicle, and switch to the first mode when the cumulative weight approaches the maximum loading weight.

17. The work machine according to claim 1, further comprising: a boom; a boom cylinder configured to drive the boom; and a pressure sensor configured to detect a pressure of the boom cylinder, wherein the controller is configured to calculate the weight of the load attracted by the lifting magnet based on a posture of the work machine and a boom bottom pressure detected by the pressure sensor.

18. The work machine according to claim 1, wherein the predetermined operational condition required for the first mode further includes at least one of: a condition that an angle of the lifting magnet is within a range that is regarded as being horizontal, a condition that a raising speed of a boom of the work machine is within a predetermined range, or a condition that movement of an attachment of the work machine is stopped.

* * * * *